United States Patent [19]

Beatty

[11] Patent Number: 4,505,455

[45] Date of Patent: Mar. 19, 1985

[54] SYNCHRONIZED DOUBLE POST FLUID OPERATED LIFT ASSEMBLY

[75] Inventor: Harry F. Beatty, Clarksville, Ind.

[73] Assignee: VBM Corporation, Louisville, Ky.

[21] Appl. No.: 390,209

[22] Filed: Jun. 21, 1982

[51] Int. Cl.[3] ..... B66F 7/12

[52] U.S. Cl. ..... 254/89 H

[58] Field of Search ..... 91/520; 92/23, 31, 51; 187/8.45, 8.5, 8.59, 8.64, 68; 254/2 B, 2 R, 89 H, 93 H, 101, 134

[56] References Cited

U.S. PATENT DOCUMENTS

| | | | |
|---|---|---|---|
| 826,132 | 7/1906 | Whitcomb | 254/101 |
| 3,829,063 | 8/1974 | Holzworth | 254/2 R |
| 3,832,852 | 9/1974 | Schmucker | 60/546 |
| 4,241,901 | 12/1980 | Shircliffe | 254/89 H |
| 4,328,951 | 5/1982 | Laupper | 187/8.5 |

*Primary Examiner*—Frederick R. Schmidt
*Assistant Examiner*—Judy J. Hartman
*Attorney, Agent, or Firm*—Maurice L. Miller, Jr.

[57] ABSTRACT

A double post lift assembly is disclosed wherein each post contains a stationary hollow tube disposed around a hydraulic cylinder and a movable hollow tube disposed around and laterally spaced from the stationary tube. A hollow sleeve is disposed in the space between the stationary and movable tubes of each post and is attached to a lower end portion of the movable tube for movement therewith. A series of spacer blocks constructed of non-abrasive material is disposed in slots arranged in two rows around each sleeve, which blocks project inwardly of the sleeves into sliding engagement with a corresponding stationary tube. A carriage arm containing an adjustable article supporting pad is attached to the lower end of each of the movable tubes. The pads are pivotally attached to the arms so that they may rock through a vertical arc and the arms are adapted to swing through a horizontal arc as the arms lift a rear end portion of a vehicle partially supported thereon. L-shaped safety latches are pivotally attached to each of the movable tubes and contain inwardly projecting legs which extend through slots in the sides of the movable tubes into sliding contact with the stationary tubes. The latches swing inwardly across upper edges of the stationary tubes when the movable tubes rise to a predetermined height to lock the movable tubes in place to prohibit accidental descent thereof upon sudden loss of fluid from the cylinders.

18 Claims, 15 Drawing Figures

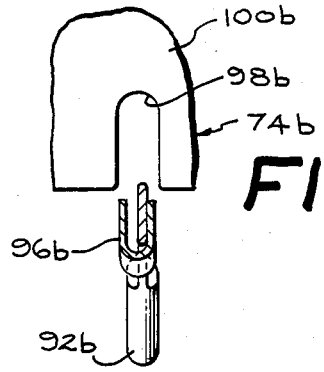
FIG. 9
FIG. 5
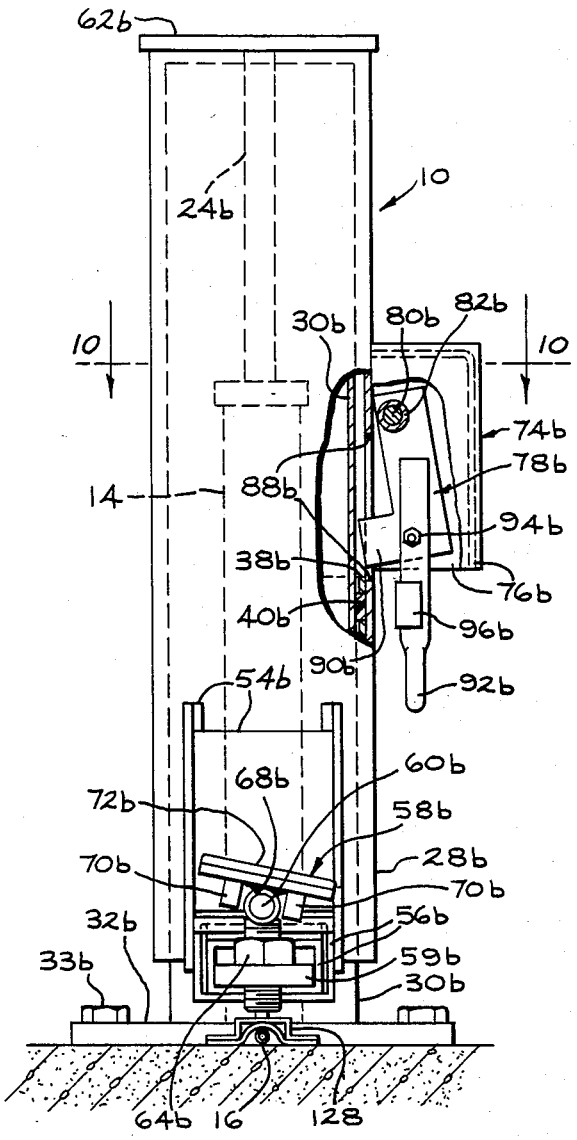
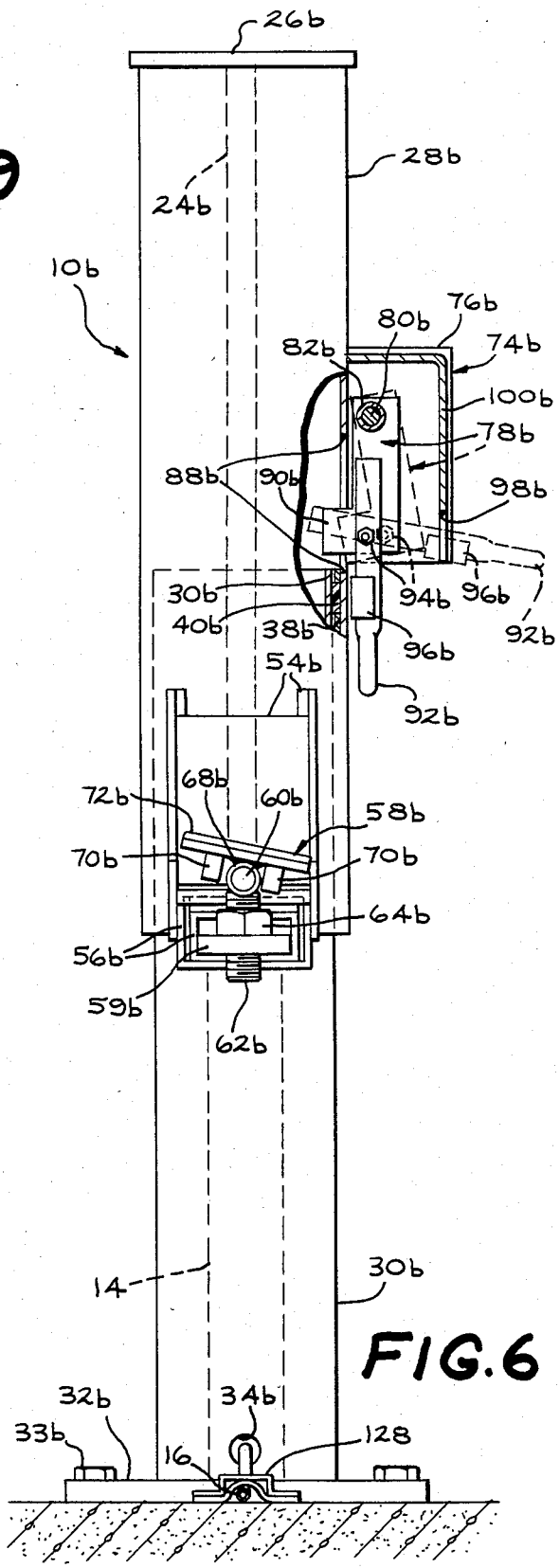
FIG. 6

SYNCHRONIZED DOUBLE POST FLUID OPERATED LIFT ASSEMBLY

BACKGROUND OF THE INVENTION

This invention relates generally to double post lifting mechanisms employing fluid operating cylinders and more specifically to hydraulic fluid driven double post automotive lifts. In addition to the structure of the double post lift assembly of the present invention, additional features include a safety latch mechanism for maintaining the article supporting carriage arms of the lift assembly at a position of maximum elevation even in the event of loss of hydraulic driving fluid pressure in the lifting cylinders and adjustable article supporting pads connected to the carriage arms which are tiltable through a vertical arc between stop members as the arms are raised and lowered.

Double post automotive lifts employing cylinders operated by hydraulic fluid supplied from a pressurized fluid source, generally speaking, have long been known in the prior art. See, for example, the automotive lift and safety latch mechanism disclosed in U.S. Pat. No. 4,241,901 issued to Donald F. Shircliffe on Dec. 30, 1980 and assigned to VBM Corporation, 1402 West Main Street, Louisville, Ky. A principal problem that has long existed in these double post lifting assemblies is the difficulty encountered in synchronizing the movement of the lifting posts so that the movable article supporting carriage assemblies track with one another in a synchronized manner throughout each lifting and lowering cycle. This problem was addressed in the Shircliffe patent wherein a complex mechanical assembly operated by the tension existing in a cable strung between the lifting posts was employed to maintain the carriage arms of each post in essentially level disposition.

In the event that the carriage arms become unsynchronized, the mechanical assembly of the subject structure actuates a pair of safety latches to stop further movement and unleveling of the carriage arms.

Additionally, in recent years, there has become a need for wheel alignment not only of the front wheels of an automobile but the rear wheels thereof as well. Front end wheel alignment is often accomplished using a conventional wheel alignment pit wherein the front wheels of an automobile are driven upon a pair of front wheel supporting pads cantilevered over one end of the pit. Rear wheel alignment requires lifting the rear wheels of the automobile clear of a supporting surface. While ordinary jacks are available for this purpose, they are not effective for rear wheel alignment purposes. It would, therefore, be desirable to provide a double post hydraulically operated lift assembly for lifting the rear wheels of the automobile off a supporting surface for rear wheel alignment purposes while allowing the front wheels to remain on the supporting pads extending over the pit. In other words, it would be desirable to provide such an assembly for lifting cantilevered loads partially supported thereby. In this manner, the alignment equipment employed in the nearby pit may be used in the rear wheel alignment procedure.

My invention accomplishes this objective and substantially overcomes the aformentioned problems encountered in prior art double post lift assemblies.

SUMMARY OF THE INVENTION

It is an object of the present invention to provide a fluid operated lift assembly.

It is a further object of the present invention to provide a carriage means for a fluid operated lift assembly which includes a vertically adjustable support pad which is adapted to rock through an arc as a massive article supported by said pad is raised and lowered.

It is yet another object of the present invention to provide a latch mechanism for a fluid operated lift assembly.

Briefly, in accordance with my invention, there is provided a lifting post for a lift assembly having a cylinder which includes a movable piston disposed therein, a stationary hollow tube disposed around the cylinder, and a movable hollow tube disposed around the stationary tube. The tubes are spaced apart laterally to provide a gap therebetween and the movable tube is connected to the piston for linear movement therewith. A hollow sleeve is disposed within and around the gap between the tubes and is fixedly connected to one end portion of the movable tube for movement therewith. The sleeve is spaced from the stationary tube and spacer means is connected to upper and lower end portions of the sleeve so as to project inwardly across the gap for slidably contacting an exterior surface of the stationary tube.

These and other objects, features and advantages of the present invention will become readily apparent to those skilled in the art from the following detailed description and attached drawings by way of which only the preferred embodiments of the present invention are illustrated.

BRIEF DESCRIPTION OF THE DRAWINGS

FIG. 5 shows a side elevation view of one of two lifting posts of the automotive lift of FIG. 1 with certain housing and casing fragments torn away to illustrate the structure and operation of a safety latch mechanism when the subject post is disposed in a fully lowered position.

FIG. 6 shows a side elevation view of the lifting post of FIG. 5 with certain housing and casing fragments torn away to further illustrate the structure and operation of the safety latch mechanism when the subject post is disposed in a fully raised position.

FIG. 9 shows an end elevation view of a latch handle employed in the latch mechanism of the present invention as viewed along cross-section lines 9—9 of FIG. 7.

DESCRIPTION OF THE PREFERRED EMBODIMENT

Figure 12:
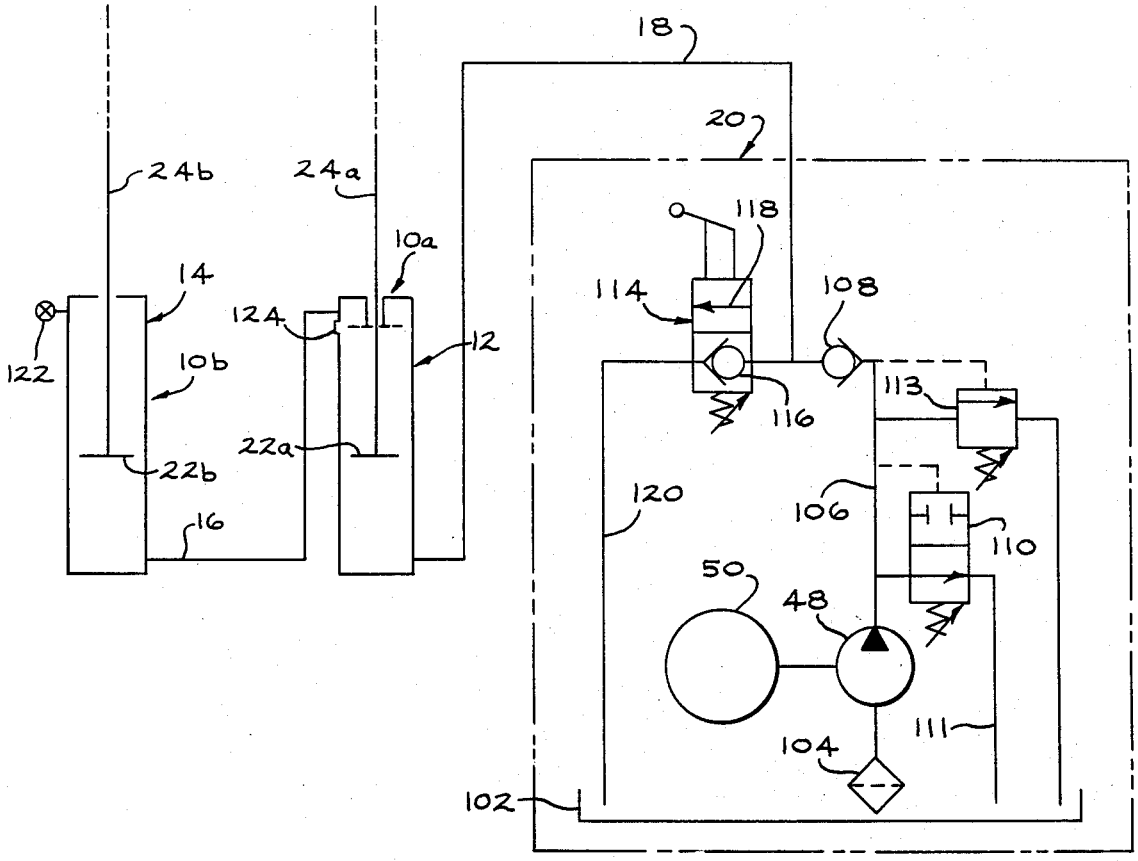
FIG. 12 shows a schematic diagram of a hydraulic system used in the automotive lift of FIG. 1.

Referring now to the drawing figures, there is shown in one preferred embodiment of my invention a fluid operated lift assembly having a pair of lifting posts 10*a,b* containing a double acting hydraulic cylinder 12 and a single acting hydraulic cylinder 14, respectively. The cylinders 12, 14 are connected to one another through a hydraulic fluid flow line 16. Hydraulic driving fluid for operating the cylinders 12, 14 is supplied to the former from a suitable pressurized source through a flow line 18 and a fluid control circuit 20 (FIG. 12 only).

Figure 4:
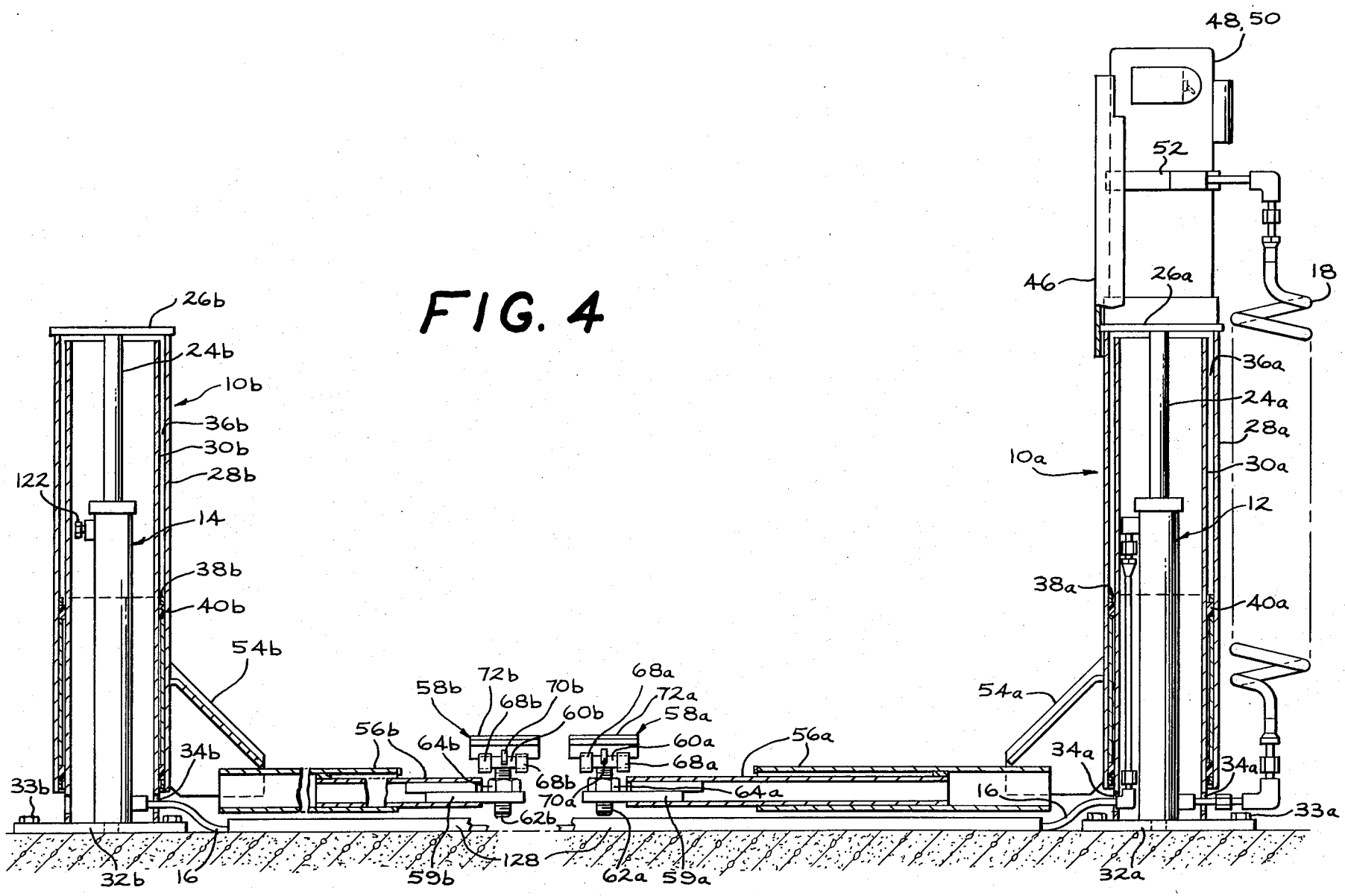
FIG. 4 shows a cross-sectional front elevation view of the automotive lift of FIGS. 1–2 as viewed along cross-section lines 4—4 of FIG. 2.
Figure 7:
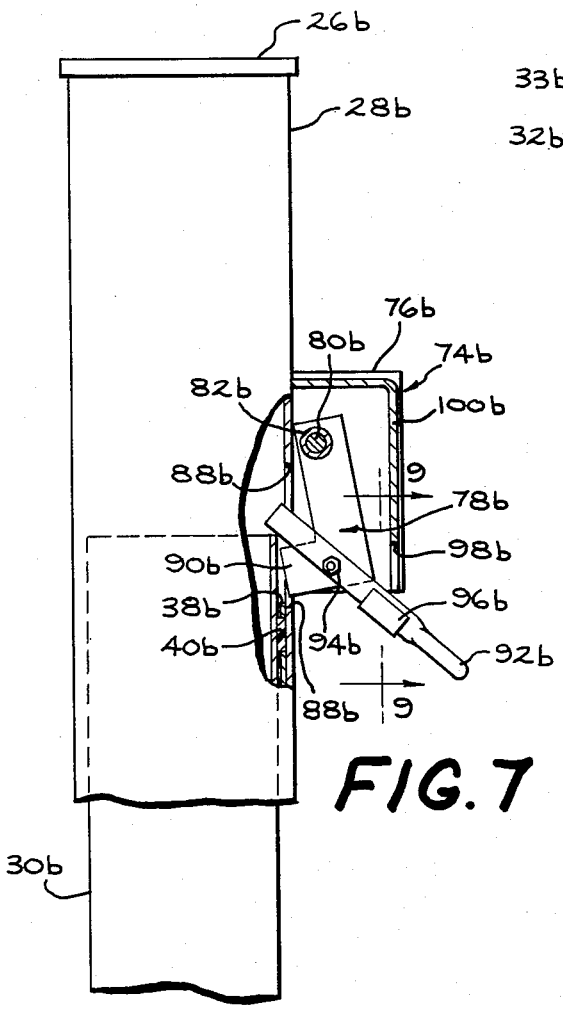
FIG. 7 shows a fragmented side elevation view of the lifting post of FIGS. 5–6 with certain housing and casing fragments torn away to illustrate the structure and operation of the safety latch mechanism when the subject post is disposed in a position intermediate the fully raised and lowered positions.
Figure 10:
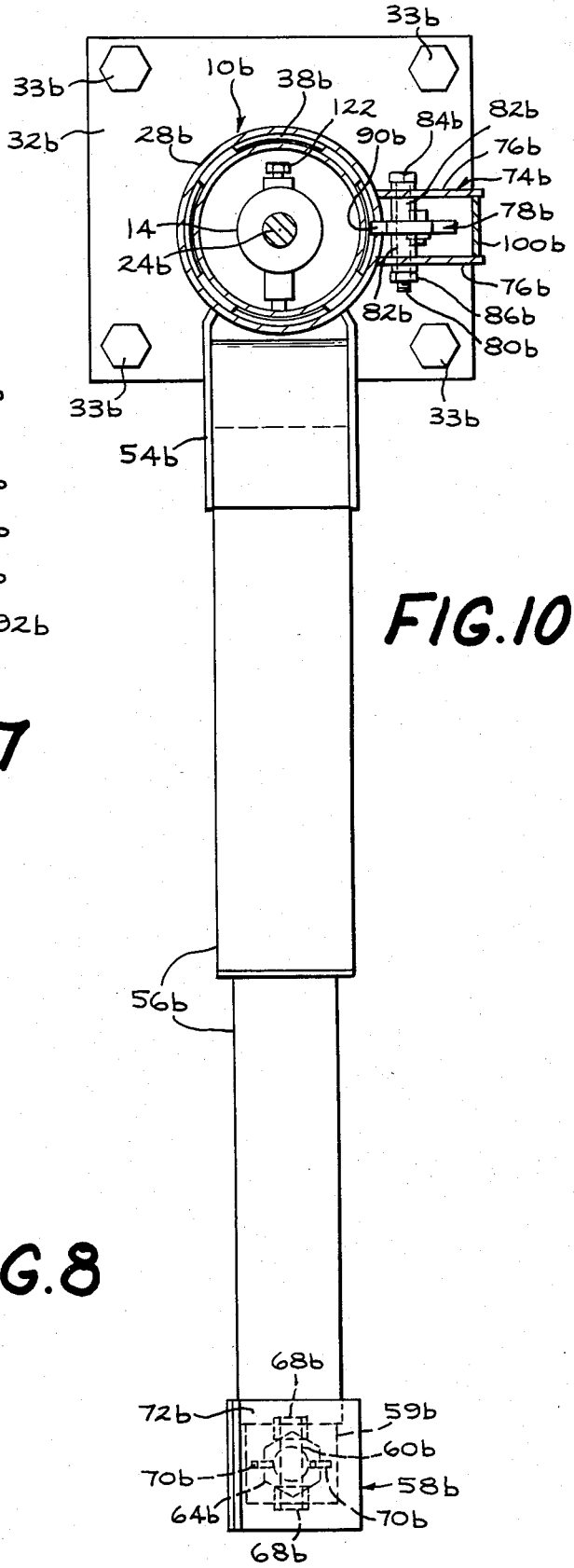
FIG. 10 shows a cross-sectional plan view of the lifting post of FIG. 5 as viewed along cross-section lines 10—10 of the latter figure.
Figure 8:
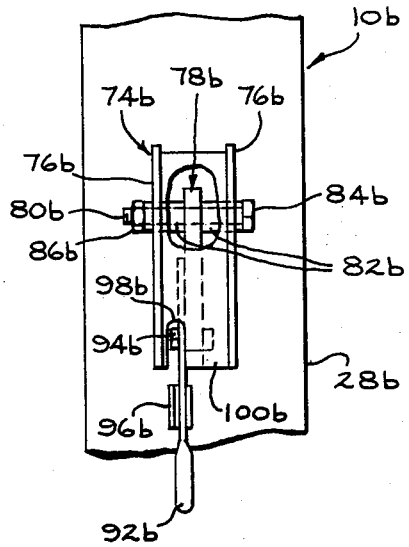
FIG. 8 shows a rear elevation view of a fragment of the lifting post of FIGS. 5–7 further illustrating the structure and operation of the safety latch mechanism.

Except for the aforementioned difference between the cylinders 12, 14, the construction of the posts 10*a,b* is essentially identical, wherein only the construction of the post 10*a* need be explained. The cylinder 12 contains a movable piston 22*a* (FIG. 12 only) to which a lower end of an elongated piston rod or ram 24*a* is connected for movement therewith. An upper end of the ram 24*a* is connected to a disc-shaped plate 26*a* which encloses the upper end of a movable hollow cylindrical outer casing or tube 28*a*. The tube 28*a* is, in turn, disposed over and around a stationary hollow cylindrical inner casing or tube 30*a* which is welded around its lower end to a supporting plate 32*a* and which is, in turn, secured to a concrete floor by means of anchor bolts 33*a*. The length of the movable outer tube 28*a* is such that when the ram 24*a* is in a fully retracted position within the cylinder 12 as shown in FIG. 4, the lower end of the tube 28*a* is spaced above the plate 32*a* a distance sufficient to allow access to the cylinder 12 with the fluid lines 16, 18 through access openings 34*a* in a base portion of the inner tube 30*a*. The tubes 28, 30 and sleeve 38 may be constructed of any suitable strong, durable material such as steel.

Figure 11:
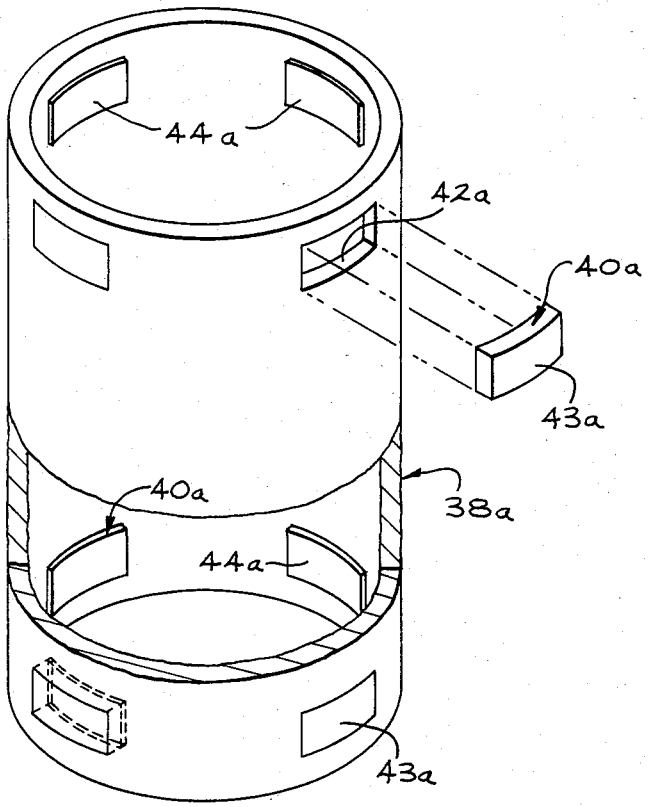
FIG. 11 shows an oblique projection of a cylindrical spacer block retainer sleeve employed in one of the posts of the automotive lift of FIG. 1 with certain parts torn away and exploded from the assembly for clarity.

The inside diameter of the movable outer tube 28*a* is greater than the outside diameter of the stationary inner tube 30*a* such that an annular gap 36*a* exists between the two tubes to prevent rubbing of one against the other when the ram 24*a* and tube 28*a* are in motion. The desired spacing between the tubes 28*a*, 30*a* is uniformly maintained around the inner and outer walls thereof by means of a cylindrically shaped sleeve 38*a* containing a series of durable plastic slide blocks 40*a* located in slots 42*a* (See FIG. 11) formed around the upper and lower ends thereof, which sleeve is disposed in a lower end portion of the gap 36*a*. The outside diameter of the sleeve 38*a* is only slightly less than the inside diameter of the movable tube 28*a* for close fitting relation therebetween. However, the thickness of the metal forming the sleeve 38*a* is substantially less than the width of the gap 36*a* such that a slight spacing exists between the interior wall of the sleeve 38*a* and the outer wall of the stationary tube 30*a*. The thickness of the various slide blocks 40*a* is greater than the thickness of the wall of the sleeve 38*a* and is at least equal to the width of the gap 36*a*. Thus when the outer faces 43*a* of the blocks 40*a* are flush with the inner surface of the tube 28*a*, the inner faces 44*a* project inwardly beyond the interior surface of the sleeve 38*a* to make slidable contact against the outer surface of the stationary tube 30*a*. The lower end of the sleeve 38*a* is welded around the perimeter thereof to the lower end of the movable outer tube 28*a* such that the tube 28*a* and sleeve 38*a* move together when the cylinder 12 and ram 24*a* are active.

The sleeve 38*a* therefore permits the movable tube 28*a* to move vertically along the stationary tube 30*a* when the cylinder 12 is operating as well as to revolve about its longitudinal axis around the stationary tube 30*a*. The blocks 40*a* thus prohibit sliding friction that would otherwise occur between the tubes 28*a*, 30*a* if the tubes were allowed to engage one another during rotational or translational movement of the tube 28*a*. The blocks 40*a* may also be constructed of other suitable non-abrasive and relatively soft material such as, for example, cast iron, brass, bronze and alloys of aluminum, lead and zinc.

The post 10*a* may be constructed in the following manner. First, the lower end of the cylinder 12 is disposed on the plate 32*a* in a fixed position as shown (See FIG. 4). Next, the stationary tube 30*a* is disposed over and around the cylinder 12 and the lower end of the tube 30*a* is welded or otherwise secured to the plate 33*a*. Preparatory to placing the movable tube 28*a* over and around the stationary tube 30*a*, the sleeve 38*a*, without the slide blocks 40*a* inserted in the slots 42*a*, is inserted into the lower end of the tube 28*a*. Next, the lower end of the sleeve 38*a* is welded around the perimeter thereof to the lower end of the movable tube 28*a*. A suitable glue, cement or other adhesive is applied to the outer face 43*a* of each of the blocks 40*a* after which the blocks 40*a* are pressed or snap-fitted by hand into the slots 42*a* by reaching through the lower end of the sleeve 38*a*. After the adhesive has dried to cause the blocks 40*a* to adhere to the inner surface of the tube 28*a*, the assembly of the movable tube 28*a* and the sleeve 38*a* thus formed is disposed over and around the stationary tube 30*a*.

The adhesive causing the block faces 43*a* to adhere to the interior surface of the movable tube 28*a* thus secures the blocks 40*a* in their corresponding slots 42*a* so that the tube 28*a* and attached sleeve 38*a* containing the blocks 40*a* can be lowered into place over and around the stationary tube 30*a* without causing the blocks 40*a* to be knocked out of the slots 42*a* during the process. Once the tube 28*a* and sleeve 38*a* is disposed over and around the tube 30*a*, the blocks 40*a* will remain trapped between the opposing surfaces of the tubes 28*a*, 30*a* and thus remain confined within the slots 42*a*. Accordingly, adhesive is applied to the block faces 43*a* only for purposes of maintaining the blocks 40*a* in position in the slots 42*a* during installation of the tube 28*a* over the tube 30*a* and serves no other purpose. Next, the end plate 26*a* is connected to the ram 24*a* after which the plate 26a is welded or otherwise secured to the upper end of the movable tube 28a.

A mounting bracket 46 is welded to an upper end of the movable tube 28a to which is secured a suitable hydraulic pump 48 and drive motor 50 by means of suitable fasteners 52 (FIG. 4 only), the pump/motor combination 48, 50 being supported by the plate 26a for movement with the tube 28a. The fluid supply line 18 extending between the pump 48 and the base of the cylinder 12 should be formed in a coil as shown in FIG. 4 or otherwise should contain a slack loop so as to allow it to extend as the tube 28a is raised to its maximum height without placing excessive tension thereon.

Figure 1:
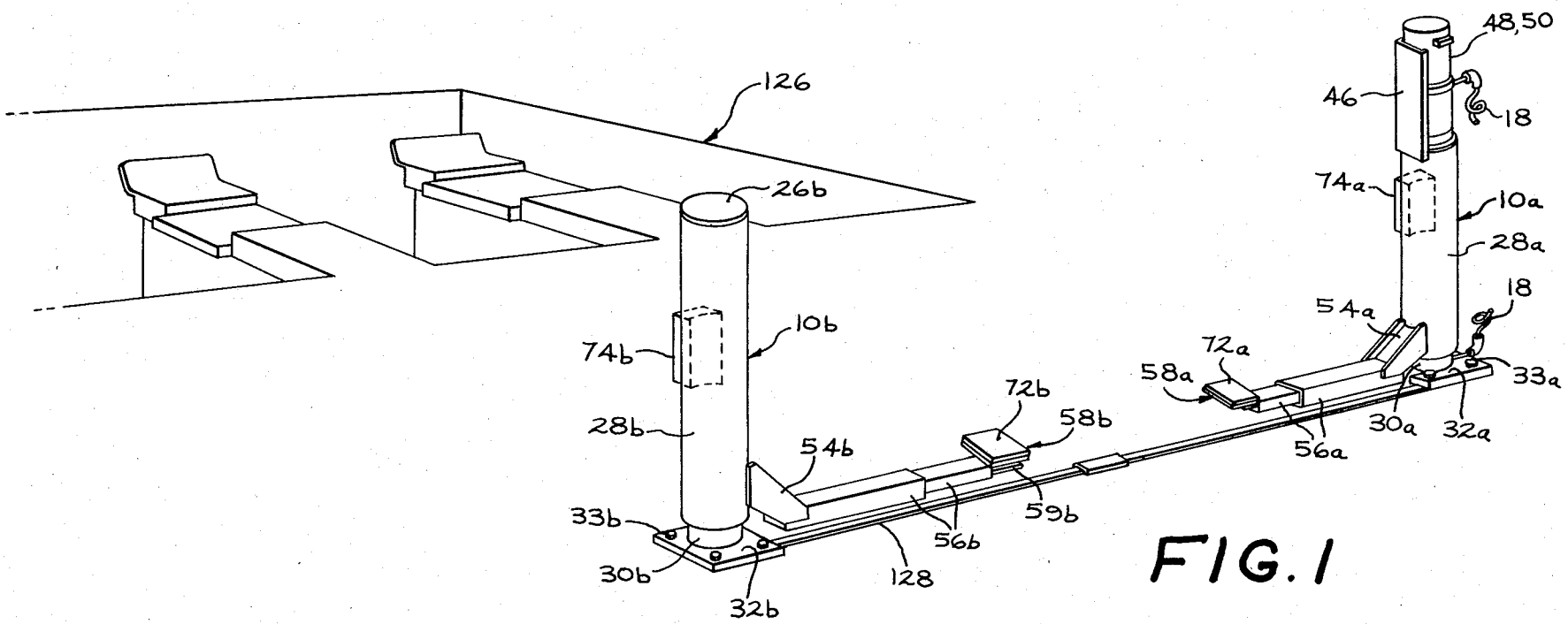
FIG. 1 shows an oblique projection of a synchronized hydraulic automotive lift disposed in spaced relation to a conventional wheel alignment pit, thus illustrating one preferred embodiment of my invention.
Figure 2:
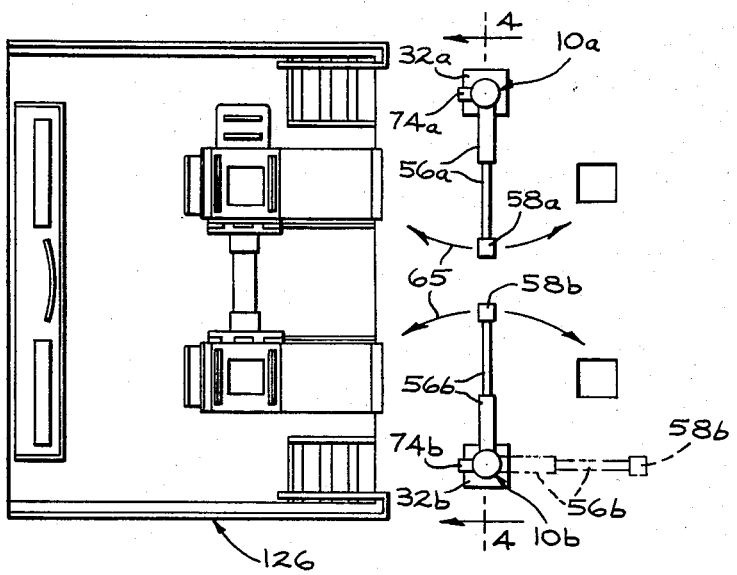
FIG. 2 shows a plan view of the automotive lift and wheel alignment pit of FIG. 1.

A mounting bracket 54a is welded to a lower end portion of the movable tube 28a opposite the sleeve 38a and adjoins one end of a telescoping and horizontally extending carriage arm 56a. A tiltable supporting pad 58a is connected to a free end portion of a flat bar 59a, the other end of which is connected to the free end of the arm 56a. A horizontally extending pin 60a located on the underside of the pad 58a is welded at mid-length to the upper end of an adjustable threaded member 62a which extends vertically through a threaded nut 64a and an unthreaded hollow shaft in a free end portion of the bar 59a. The telescoping carriage arms 56a,b may thus be adjusted in length to properly position the supporting pads 58a,b, respectively, under the frame of an automobile 125 for lifting a rear end portion of the same (See FIGS. 1–4). In addition, the rotational capability of the tube 28a permits the carriage arm 56a to be swung through a 180° degree horizontal arc as indicated in FIG. 2 by arrows marked 65. Opposite ends of the pin 60a are rotatably confined within a pair of end caps or bosses 68a which are, in turn, welded or otherwise fixedly attached on upper surface portions thereof to the underside of the pad 58a. The bosses 68a thus turn freely about the ends of the stationary pin 60a to allow the pad 58a to tilt or rock about the longitudinal axis of the pin 60a. A pair of blocks 70a connected to the underside of the pad 58a on opposite sides of the pin 60a alternately engage an upper end of the threaded member 62a and thus act as stops for limiting the vertical arc through which the pad 58a is permitted to rock. A molded, skid resistant layer 72a of rubber or other suitable material is attached to an upper broad surface of the pad 58a. The height of the pad 58a is adjustable on the threaded member 62a by rotating or spinning the pad 58a horizontally. Consequently, the pad 58a is also rotatable as the arm 56a swings through a horizontal arc while raising and lowering a cantilevered load partially supported on the pad 58a as, for example, the automobile shown in FIG. 3.

Each of the posts 10a,b is provided with a safety latch mechanism 74a,b, respectively, (See FIG. 2), the structure and operation of which is shown in FIGS. 5–10. Since the mechanisms 74a,b are identical, only the mechanism 74b attached to the post 10b is shown in detail in the drawings and described herein. The mechanism 74b includes a box-shaped housing having a pair of spaced vertically extending side plates 76b welded to the exterior surface of the movable tube 28b. An L-shaped latch 78b is disposed between the side plates 76b and is suspended from a bolt 80b which acts as a pivot pin and which extends between side plates 76b and through a hole in an upper end portion of the latch 78b. A pair of hollow sleeves 82b are disposed over the bolt 80b on opposite broad sides of the latch 78b and extend through the side walls 76b between the bolt head 84b and a nut 86b to confine the latch 78b in a centered position on the bolt 80b between the sidewalls 76b. A slot 88b is formed through the vertical wall of the movable tube 28b through which a lower leg 90b of the latch 78b projects. The bolt 80b extends between the sidewalls 76b relatively close to the wall of the tube 28b so that the L-shaped latch 78b is tilted rearwardly when the leg 90b projects through the slot 88b against the wall of the stationary tube 30b (See FIGS. 5 and 7). The mechansim 74b is positioned at a height on the sidewall of the movable tube 28b such that when the ram 24b and tube 28b are driven to maximum height, the L-shaped latch 78b will swing by gravity about the pin 80b inwardly seeking its natural position across the upper edge of the stationary tube 30b as the lower end of the latch 78b rises with the tube 28b above the sidewall of the tube 30b. The post 10b is shown in FIG. 6 in a position of maximum vertical extension of the ram 24b and movable tube 28b such that the lower end portion of the leg 90b of the latch 78b hangs directly above the upper edge of the stationary tube 30b and is spaced slightly above the latter by one-quarter to one-half inch. In actual practice, the operator of the lift assembly should thereafter activate the cylinders 12, 14 to remove a slight amount of hydraulic fluid from below the pistons 22a,b (FIG. 12) to slightly lower the rams 24a,b and movable tubes 28a,b from the position of maximum height as shown in FIG. 6, until the lower edges of the leg 90b of latch 78b engages the upper edge of the stationary tube 30b to provide positive support for the tube 30b, and attached carriage arm 56b.

The latch 78b is thereafter disengaged by activating the cylinders 12, 14 to raise the tubes 28a,b a slight distance back to the maximum extended position of the rams 24a,b such that bearing pressure is removed from the lower edge of the latch leg 90b and the corresponding leg of the latch assembly 74a on the post 10a. An elongated handle 92b which is pivotally connected by a nut and bolt 94b to a mid-portion of the leg 90b may then be raised through a vertical arc to a position wherein a spring steel clip or catch 96b attached to the handle 92b and the latter engage the sidewalls of a downwardly opening slot 98b located in a lower end portion of a back wall 100b of the latch housing. The clip 96b thus holds the handle 92b in a raised position in the slot 98b until released by hand pressure. Raising of the handle 92b as aforesaid causes the latch 78b to be tilted rearwardly so that the free end of the leg 90b now clears the upper edge of the stationary tube 30b to thus permit the movable tube 28b to be lowered by the cylinder 14 and ram 24b (See the handle 92b and latch 78b as shown in phantom in FIG. 6).

With the handle 92b and catch 96b trapped in the slot 98b and with the latch 78b thus tilted rearwardly away from the upper edge of the tube 30b, the cylinder 14 may then be activated to lower the movable tube 28b and carriage arm 56b. As the tube 28b descends around the tube 30b, an inwardly projecting end portion of the handle 92b strikes an upper edge of the stationary tube 30b (See FIG. 7 wherein the tube 28b is shown at such an intermediate position of descent). As the tube 28b descends still further, the inwardly projecting end of the handle 92b is forced upwardly by the upper edge of the tube 30b whereby the outwardly projecting end of the handle 92b is pivoted downwardly out of the slot 98b by action of pivot pin 94b. Upon clearing the slot 98b, the handle 92b falls to a vertical position as shown in FIG. 5. An upper inwardly projecting tip of the leg 90*b* thus projects through the movable tube slot 88*b* and slides along the exterior surface of the stationary tube 30*b* as the tube 28*b* continues its descent.

I have also used a piece of compressible, resilient rubber tubing around the 92*b* as a substitute for the spring steel clip 96*b* as shown. But while I find that such tubing holds well in the slot 98*b*, I also find it susceptible to wear and abrasion as the handle 92*b* is repeatedly jerked upwardly by hand into the slot 98*b* and, for that reason, I prefer to use the spring steel clip 96*b* as shown and described.

Referring now particularly to FIG. 12, the hydraulic fluid circuit 20 containing the pump 48 and motor 50 will now be explained. A suitable container 102 serves as a fluid reservoir or source from which hydraulic fluid is supplied to the pump 48 through a conventional inlet strainer 104. The fluid thus supplied to the pump 48 is pumped, upon command, through flow line 106, back pressure check valve 108 and the line 18, to a lower end portion of the cylinder 12 to lift the piston 22*a*, ram 24*a* and carriage arm 56*a*. A conventional normally open load delay valve 110 diverts fluid from line 106 through a line 111 to the reservoir 102 for a brief time period after the pump 48 is activated, to allow the latter to reach operating speed under lightly loaded conditions. A rate of flow sensor associated with the load delay valve 110 senses when the pump 48 has reached operating speed at which point, the valve 110 closes to shut off further diversion of hydraulic fluid back to the reservoir 102. The normally closed check valve 108 will not open to allow fluid to pass from the line 106 into the line 18 until the fluid pressure in the line 106 exceeds the fluid pressure in the line 18 which will be dependent upon the downward force exerted on the piston 22*a* by the ram 24*a*, tube 28*a*, carriage arm 56*a*, pump/motor combination 48,50 and the weight of any object being supported by the pad 58*a*. To operate the cylinder 12 to raise the piston 22*a*, a conventional two-position fluid switch 114 is closed to the position shown in FIG. 12. A check valve 116 is thus maintained in the closed position shown by the fluid pressure in the line 106. A suitable and conventional, normally closed, adjustable pressure relief valve 113 is connected between the line 106 and the reservoir 102 to divert hydraulic fluid from the line 106 when the pressure therein exceeds a preselected maximum value such as, for example, 800 psi.

To lower the cylinders 12, 14, the switch 114 is thrown to an open position, opposite that shown in FIG. 12, wherein fluid within the cylinder 12 below the piston 22*a* is forced out of the cylinder 12 back through the line 18 and through a switch section 118, thence through a reservoir return line 120 to the reservoir 102. As the piston 22*a* descends, hydraulic fluid in a lower end portion of the cylinder 14 below the piston 22*b* is forced back through the line 16 to an upper chamber of the cylinder 12 above the piston 22*a* by downward force exerted on the piston 22*b*. An air breather valve 122 located in an upper end portion of the cylinder 14 permits ambient air to be drawn into the chamber above the piston 22*b* to permit the piston 22*b* to descend as and when required. Conversely, the valve 122 allows air to escape from the cylinder 14 above the piston 22*b* to allow the latter to ascend as and when required.

The volumes of the cylinders 12, 14 should be selected such that a given volume of hydraulic fluid transferred through the line 16 will result in the raising or lowering of the pistons 22*a,b* by a nearly identical amount. However, due to slight manufacturing deviations between any two cylinders such as the cylinders 12, 14, a slight difference between the volumes of the cylinders 12, 14 can nearly always be anticipated. No matter how slight such differences, repeated raising and lowering of the pistons of any two selected cylinders would cause accumulating errors in the respective levels of the carriage arms 56*a,b*. To avoid this problem, a slot 124 is provided in an upper end of the cylinder 12 to allow hydraulic fluid to be shunted around the piston 22*a* each time it is raised to its maximum height. Thus, each time the piston 22*a* of the cylinder 12 is driven by the circuit 20 to its maximum height, a sufficient quantity of hydraulic fluid will be supplied through the line 18, and lower chamber of the cylinder 12, through the slot 124 and line 16 to likewise drive the piston 22*b* of the cylinder 14 to its full height and to eliminate any slight error in height between the carriage arms 56*a,b* which may have occurred since the pistons 22*a,b* were last raised to their maximum heights.

Figure 3:
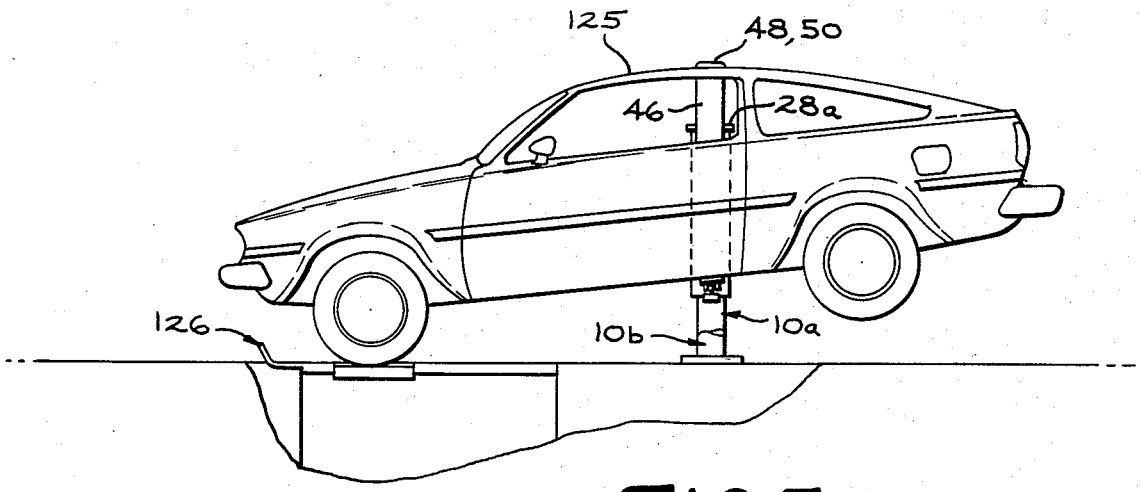
FIG. 3 shows a side elevation view of an automobile having its rear wheels raised above a floor by the lift of FIG. 1.

In practice, I propose to use the lift assembly of the present example as an automotive lift to lift the rear ends of automobiles, such as the automobile 125 shown in FIG. 3, to a preselected height to permit both front and rear wheel alignment. Front end alignment may be accomplished by a conventional wheel alignment pit 126 (See FIGS. 1–3) presently found in many automotive wheel alignment installations. The posts 10*a,b* may be positioned as shown in FIGS. 1–3 in front of the entrance to the pit 126. A suitable elongated metal line cover or shield 128 may be employed to cover the flow line 16 to protect the latter from damage as the front wheels of the automobile 125 roll thereover when being positioned for alignment in the pit 126.

Upon initial connection of the cylinders 12, 14 together through the line 16 and connection of the cylinder 12 through the line 18 to the hydraulic circuit 20, the pistons 22*a,b* will be in a fully lowered position. The pump 48 is activated without a load being applied to the pads 58*a,b* and the valve 114 is opened to the position shown in FIG. 12 to supply hydraulic fluid through the line 18 to the lower chamber of the cylinders 12 below the pistons 22*a*, whereupon the piston 22*a* rises in the cylinder 12 until it reaches its maximum height. When the piston 22*a* reaches maximum height, a portion of the hydraulic fluid flowing into the lower chamber of the cylinder 12 will flow through the slot 124 and thus be shunted around the piston 22*a* through the line 16 and into the lower chamber of the cylinder 14 below the piston 22*b*. Accordingly, the piston 22*b* will rise to a position of maximum height in the cylinder 14 as hydraulic fluid continues to flow into the latter. When the piston 22*b* reaches maximum height in the cylinder 14, the switch 114 may be thrown to the open positon, opposite the position shown in FIG. 12, so that the weight of the pad 58*a*, carriage arm 56*a*, tube 28*a*, pump/motor combination 48, 50 and ram 24*a* bearing upon the piston 22*a* drives the latter downward to force hydraulic fluid out of the cylinder 12, back through the line 18, valve section 118 and line 120 to the reservoir 102. As the piston 22*a* begins to descend, the hydraulic fluid now located in the cylinder 14 is forced back through the line 16 into an upper chamber of the cylinder 12 above the piston 22*a* as the piston 22*b* descends in the cylinder 14 under the weight of the structural assembly bearing thereon. Thus, upon completion of an initial cycle of operation, hydraulic fluid fills the upper chamber of the cylinder 12 to be transferred through the line 16 to raise the piston 22*b* simultaneously with the next raising of the piston 22*a*.

To complete the description of the subject example of my invention, the following table lists specific components which I have found to be suitable for use therein.

| ELEMENT | DESCRIPTION |
|---|---|
| Cylinder 12 | LANTEX HYDRAULICS #5447-BL Lancaster, Texas |
| Cylinder 14 | LANTEX HYDRAULICS #5448-BL |
| Fluid Control Circuit 20 (Including pump 48, motor 50, Load delay valve 110, check valve 108, pressure relief valve 113 and fluid switch 114) | MTE Power Unit #5201T-2687 MTE Hydraulics Co., Rockford, Illinois |
| Hose 18 | #116-00330-01 Dana Corporation Weatherhead Division |
| Slide Blocks 40a including thickness | Injection Molded UHMW polyethylene, ¼ inch thick |

Figure 14:
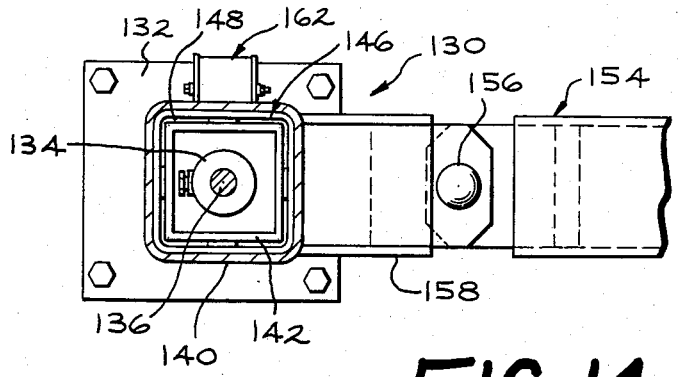
FIG. 14 shows a cross-sectional plan view of the lifting post of FIG. 13.
Figure 13:
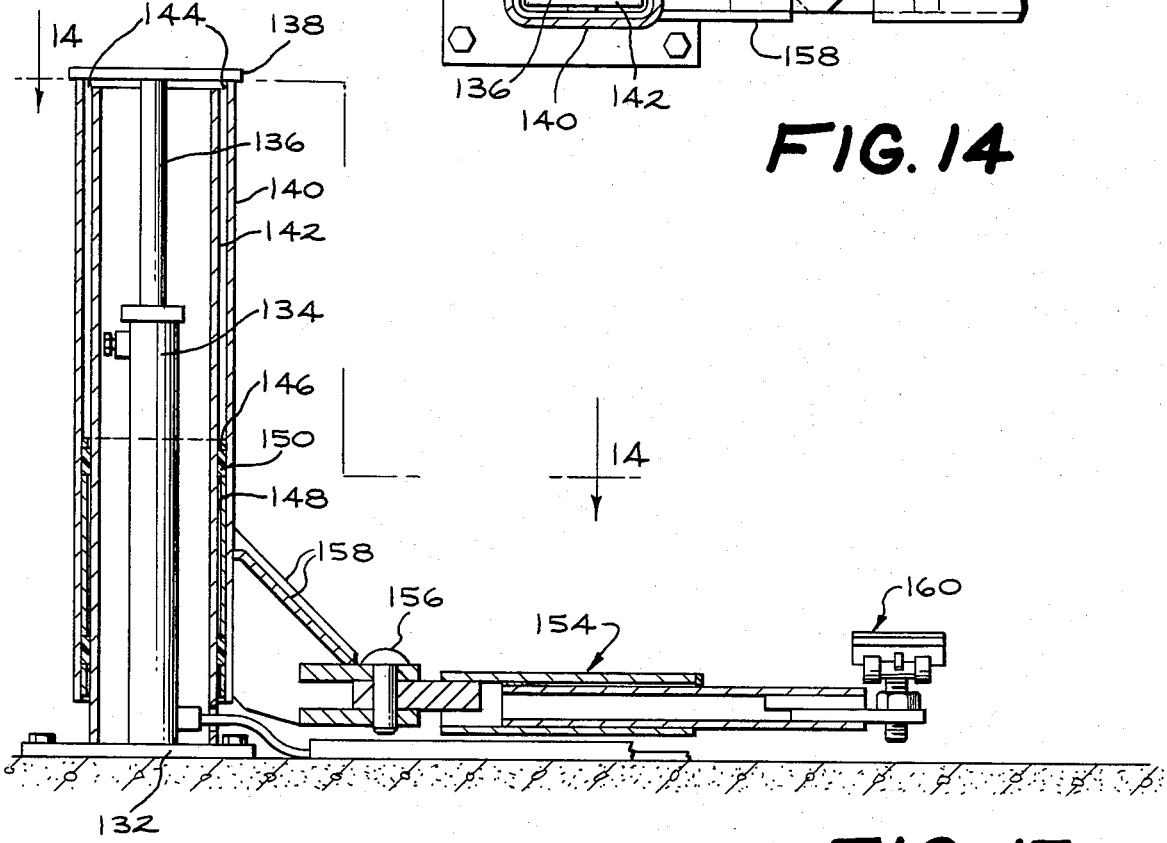
FIG. 13 shows a side elevation view of one of a pair of lifting posts of a lift assembly with certain portions torn away for clarity, thus illustrating another preferred embodiment of the present invention.
Figure 15:
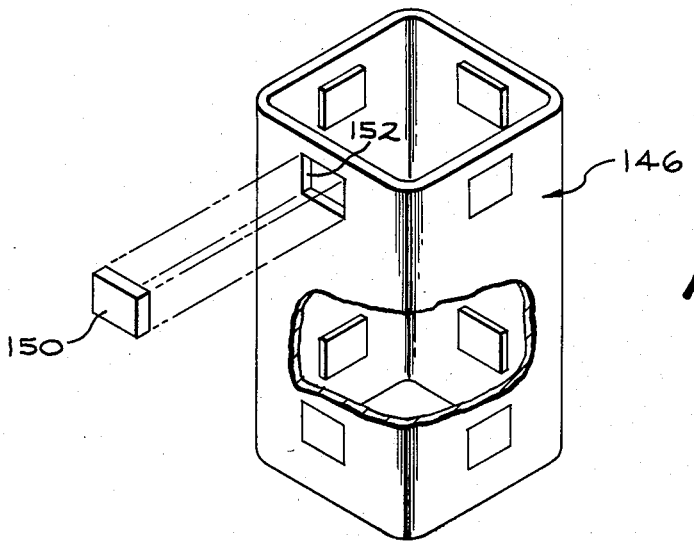
FIG. 15 shows an oblique projection of a rectangularly shaped spacer block retainer sleeve employed in the lifting post of FIGS. 13–14.

Referring now to FIGS. 13–15, there is shown, in another preferred embodiment of my invention, a single lifting post 130 which includes a base plate 132 to which is connected the lower end of a single acting hydraulic cylinder 134 having a movable cylinder rod or ram 136 connected to a flat, rectangularly shaped closure plate 138 which is, in turn, attached to the upper end of a hollow movable tube 140, also of rectangular cross-section. The tube 140 is disposed over a hollow stationary tube 142 of rectangular cross-section which is mounted on the plate 132 around the cylinder 134. A gap 144 exists between the inner and outer vertical surfaces of the tubes 140, 142, respectively, within a lower end portion of which is disposed a sleeve 146 of rectangular cross-section (See particularly FIGS. 14–15).

As in the previous example, the sleeve 146 is fastened in a suitable manner to the tube 140 for ascending and descending movement, therewith along and around the tube 142. The thickness of the sleeve 146 is less than the thickness of the gap 144 so that a slight gap 148 exists between the inner surfaces of the sleeve 146 and the outer surfaces of the stationary tube 142. A series of non-abrasive spacer blocks 150 are disposed in slots 152 arranged on upper and lower end portions of each vertical surface of the sleeve 146 which are thicker than the thickness of the sleeve 146 and which, when flush with the outer surfaces of the latter, project inwardly across the gap 148 into sliding engagement with the vertical walls of the tube 142. The blocks 150 may be constructed of the same non-abrasive material as the blocks 40*a* of the previous example. The cylinder 134, tubes 140 and 142, and the sleeve 146 containing spacer blocks 150 may be assembled in the same manner as previously explained with regard to the cylinder 12, tubes 28*a*, 30*a*, and the sleeve 38*a* of the previous example.

A carriage arm 154 is pivotally attached by means of a pin 156 to a mounting bracket 158 which is, in turn, fixedly connected to a lower end portion of one side wall of the tube 140 opposite the sleeve 146. A rockable support pad 160 is connected to one end of the arm 154 which is of the same type as shown in the prior example. Since the tubes 140, 142 of the present example are of rectangular cross-section, the movable tube 140 will not rotate around the stationary tube 142 as was possible using the cylindrical tubes 28*a*, 30*a* of the previous example. Since in lifting the rear end of an automobile above the ground with the front wheels maintained in a stationary position, it will be necessary for both the support pad 160 to rock through a vertical arc and the arm 154 to revolve through a horizontal arc (See FIGS. 2–3 of the previous example), the present example requiring that the arm 154 be hingably connected to the tube 140. A safety latch 162 having the same features as the latch 74*b* of the prior example is connected to one vertical wall of the movable tube 140. In actual practice, a pair of lifting posts having the structural features of the post 130 would be employed to lift an automobile such as shown in FIG. 3, for example.

Although the present invention has been shown and described with respect to specific details of certain preferred embodiments thereof, it is not intended that such details limit the scope of the present invention otherwise than as specifically set forth in the following claims.

I claim:

1. A lifting post for a lift assembly comprising a cylinder including a movable piston disposed therein, a stationary hollow tube disposed around said cylinder, a movable hollow tube disposed around said stationary tube, said tubes being spaced apart laterally to provide a gap therebetween, said movable tube being connected to said piston for linear movement therewith, a hollow sleeve disposed within and around said gap and being fixedly connected to one end portion of said movable tube for movement therewith, said sleeve being disposed around and laterally spaced from said stationary tube, and spacer means connected to upper and lower end portions of said sleeve and projecting inwardly across said gap for slidably contacting an exterior surface of said stationary tube.

2. The post of claim 1 wherein said tubes and sleeve are cylindrically shaped, said movable tube being freely rotatable about its longitudinal axis.

3. The post of claim 1 wherein said spacer means is constructed of non-abrasive material selected from the group consisting of plastic, cast iron, brass, bronze, and alloys of aluminum, lead and zinc.

4. The post of claim 1 further comprising gravity actuated safety latch means pivotally attached to said movable tube for preventing accidental descent of said movable tube from a predetermined height relative to said stationary tube upon loss of hydraulic pressure in said cylinder.

5. The post of claim 1 further comprising a motor and pump combination attached to one end of said movable tube for movement therewith.

6. The post of claim 1 wherein said spacer means comprises a series of spacer blocks disposed in slots arranged in at least two rows formed in and spaced around said sleeve.

7. The post of claim 4 wherein said safety latch means comprises an L-shaped latch pivotally connected on an upper end portion thereof to an exterior surface of said movable tube for rocking movement of an inwardly projecting lower leg of said latch, said movable tube defining a slot through which an end of said lower leg projects, said latch being connected at a vertical position on said movable tube such that, when said movable tube ascends to a position of maximum upward displacement, a lower edge portion of said lower leg raises above an upper edge of said stationary tube and swings inwardly of said post by action of gravity across said upper edge to a position of interference with descending movement of said movable tube, and handle means pivotally connected to a lower end portion of said latch for drawing said lower leg outwardly of said post such that said lower edge portion clears the upper edge of said stationary tube to permit descending movement of said movable tube.

8. The post of claim 7 further comprising a latch housing containing said latch fixedly connected to said movable tube and defining a vertically extending outer wall, a lower end portion of said outer wall defining a downwardly opening slot, said handle means comprising an elongated handle pivotally attached on a mid-portion of the length thereof to said latch, a grippable end portion of said handle being pivotal upwardly into said downwardly opening slot to draw said lower leg out of interferring relation with the upper end of said stationary tube when said movable tube is disposed in a position of maximum upward displacement, an end portion of said handle opposite said grippable end portion projecting inwardly of said post across an upper edge portion of said stationary tube when said grippable end portion is disposed in said downwardly opening slot, and means attached to said grippable end portion of said handle for holding said grippable end portion in said downwardly opening slot when said inwardly projecting end portion is spaced above the upper edge of said stationary tube, whereby upon descent of said movable tube from said position of maximum upward displacement, the upper edge of said stationary tube contacts said inwardly projecting end portion to force said grippable end portion out of said downwardly opening slot to allow said lower leg to swing inwardly against said stationary tube, said handle being adapted to hang in a vertically extending position when said grippable end portion is clear of said downwardly projecting slot.

9. The post of claim 6 wherein each of said rows contains four of said blocks spaced equidistantly around said sleeve.

10. The post of claim 1 further comprising a carriage arm connected to said movable tube opposite said sleeve for translational movement with said movable tube, said arm being swingable through a horizontal circular arc, said sleeve and spacer means restraining said movable tube from tilting relative to said stationary tube, and an article supporting pad connected to said carriage arm, said pad being freely rotatable about a vertical axis and freely rockable through a vertical arc between stops, whereby said post can lift and lower a cantilevered load partially supported by said arm and pad.

11. In a double post fluid operated lift assembly, a post comprising a hydraulic cylinder including a movable piston member disposed therein, a stationary hollow tube disposed around said cylinder, a movable hollow tube disposed around said stationary tube, said tubes being spaced apart laterally to provide a gap therebetween, said movable tube being connected to said piston member for translational movement therewith, a hollow sleeve disposed within and around said gap and being fixedly connected to said movable tube for movement therewith, said sleeve being spaced from said stationary tube, spacer means constructed of relatively non-abrasive material connected to upper and lower end portions of said sleeve and projecting inwardly of said sleeve for slidable contact against said stationary tube, a carriage arm connected to said movable tube opposite said sleeve for translational movement with said movable tube, said arm being swingable through a horizontal circular arc, said sleeve and spacer means restraining said movable tube from tilting relative to said stationary tube, and an article supporting pad connected to said carriage arm, said pad being freely rotatable about a vertical axis and freely rockable through a vertical arc between stops, whereby said post can lift and lower a cantilevered load partially supported by said arm and pad.

12. The post of claim 11 further comprising gravity actuated safety latch means pivotally attached to said movable tube and adapted to swing over an upper edge of said stationary tube when said piston member and movable tube reach a predetermined position of upward displacement to prevent said movable tube and arm from accidentally descending from said position upon loss of pressure in said cylinder.

13. The post of claim 11 wherein said tubes and sleeve are cylindrically shaped and wherein said movable tube and sleeve are rotatable about their vertical axes in response to the rotation of said arm through a horizontal arc occurring while lifting and lowering a cantilevered load partially supported by said arm.

14. The post of claim 11 further comprising a fluid pump and pump drive motor for supplying pressurized driving fluid to said cylinder mounted on said movable tube for movement therewith.

15. The post of claim 12 wherein said latch means comprises an L-shaped latch pivotally connected on an upper end portion thereof to an exterior surface of said movable tube for rocking movement of an inwardly projecting lower leg of said latch, said movable tube defining a slot through which an end of said lower leg projects, said latch being connected at a vertical position on said movable tube such that, when said movable tube ascends to a position of predetermined upward displacement, a lower edge of said lower leg raises above an upper edge of said stationary tube and swings inwardly of said post across said upper edge to a position of interferring relation with descending movement of said movable tube, and handle means connected to said latch below the point of pivotal attachment thereof for drawing said lower leg outwardly of said post such that the free projecting end of said lower leg clears the upper edge of said stationary tube to permit descending movement of said movable tube from said predetermined position.

16. The post of claim 15 further comprising a latch housing fixedly connected to said movable tube and defining vertically extending rear and side walls enclosing said latch, a lower end portion of said rear wall defining a downwardly opening slot therein, said handle means comprising an elongated handle pivotally attached on a mid-portion of the length thereof to said length, a grippable end portion of said handle being pivotal upwardly into said downwardly opening slot to draw said lower leg out of interferring relation with the upper edge of said stationary tube when said movable tube is disposed in a position of predetermined upward displacement, an end portion of said handle opposite said grippable end portion projecting inwardly of said post across the upper edge portion of said stationary tube when said grippable end portion is disposed in said downwardly opening slot, and means attached to said grippable end portion of said handle for holding said grippable portion in said downwardly opening slot when said inwardly projecting end portion is spaced above the upper edge of said stationary tube, whereby upon descent of said movable tube from said position of predetermined upward displacement, said upper edge of said stationary tube contacts said inwardly projecting end portion to force said grippable end portion out of said downwardly opening slot to allow said lower leg to swing inwardly against said stationary tube, said handle being adapted to hang in a vertically extending position when said grippable end portion is clear of said downwardly projecting slot.

17. The lift assembly of claim 11 wherein said tubes and sleeves are of rectangular cross-section, said carriage means being pivotally attached to said movable tube for pivotal movement through a circular horizontal arc.

18. The post of claim 11 further comprising a pair of spaced bosses fixedly connected to an underside of said pad, an adjustable threaded member disposed through said carriage arm, a pivot pin fixedly connected on a mid-portion of the length thereof to an upper end of said threaded member, opposite ends of said pin being rotatably disposed in said bosses, whereby said pad and bosses are adapted for rocking motion about said pin, and a pair of downwardly projecting stop members attached to the underside of said pad on opposite sides of said pin and adapted to alternately engage an upper edge portion of said threaded member to define an arc through which said pad is rockable.

* * * * *